United States Patent [19]

Gustavsson

[11] Patent Number: 4,546,755

[45] Date of Patent: Oct. 15, 1985

[54] CHAIN SAW SEALING DEVICE

[76] Inventor: Ove Gustavsson, Alsjögatan 25, S-641 51, Katrineholm, Sweden

[21] Appl. No.: 541,338

[22] PCT Filed: Feb. 9, 1983

[86] PCT No.: PCT/SE83/00043

§ 371 Date: Sep. 26, 1983

§ 102(e) Date: Sep. 26, 1983

[87] PCT Pub. No.: WO83/02746

PCT Pub. Date: Aug. 18, 1983

[30] Foreign Application Priority Data

Feb. 16, 1982 [SE] Sweden ..... 8200907

[51] Int. Cl.[4] ..... B28D 1/08

[52] U.S. Cl. ..... 125/21; 83/830

[58] Field of Search ..... 125/21; 83/830, 831, 83/832, 833, 834

[56] References Cited

U.S. PATENT DOCUMENTS

| | | | |
|---|---|---|---|
| 1,736,607 | 11/1929 | Legge | 125/21 |
| 3,459,169 | 8/1969 | McNulty | 125/21 |
| 3,587,679 | 6/1971 | Conte | 125/21 |
| 3,741,192 | 6/1973 | Avery | 125/21 |

*Primary Examiner*—Harold D. Whitehead

*Attorney, Agent, or Firm*—Watson, Cole, Grindle & Watson

[57] ABSTRACT

The saw-chain of a chain saw includes a plurality of link assemblies, each link assembly including a working link having a cutter element attached thereto, a control link having a control lug which extends into a guide groove in the peripheral edge of the saw-bar and a connecting link, each link having opposite side faces, and a unitary plastic sealing means attached to the opposite side faces of the links and including overlapping edge portions which extend along the opposite side faces of the saw-bar.

4 Claims, 2 Drawing Figures

CHAIN SAW SEALING DEVICE

BACKGROUND OF THE INVENTION

1. Field of the Invention

The present invention relates to a chain saw, preferably a so-called motor saw, which is useful in sawing concrete and similar, preferably hard, materials. Such chain saws include a motor which drives an enclosed saw-chain arranged along the edge of a saw-bar, the saw-chain comprising links, of at least some of which are fitted with at least one cutter projecting from the saw-bar.

2. The Prior Art

The known motor-saws are provided with a saw-chain consisting of three types of links which are movably arranged with respect to one another by means of pins in the same way as with known roller-chains. The links consist of saw-links provided with one or several sawteeth respectively, connecting links and control links provided with a drive and control lug extending into a guide groove which extends along the edge of the saw-bar. The saw-links and connecting links are joined in pairs, parallel and next to one another, by means of pins in such a way that each pair of links consists of a saw-link and a connecting link or two connecting links. Furthermore, the pairs of links are mutually connected by the control-links so as to form a chain.

The known saw-chain has the disadvantage that, when it is used for sawing hard materials such as, e.g., concrete, abraded wear-producing material collects in the chain gaps, which causes rapid wear of the chain's gliding surfaces, both in the actual chain and within the guide groove within the bar. Also, the drive arrangement fitted to the motor of the saw and driving the chain around the bar becomes worn, owing to the action of the abraded material.

SUMMARY OF THE INVENTION

The aim of the present invention consists in eliminating these disadvantages. The aim has been achieved by a sealing arrangement for an enclosed saw-chain arranged to move along the edge of a saw-bar and comprising links, some of which at least are provided with a cutter and some at least with a control lug, substantially located in a single plane through the saw-bar, whereby the cutter is directed outward from the bar and the control lugs are orientated inwardly towards the bar and engage a guide groove extending along the edge of the bar, with the links being movably joined with one another. The invention is characterised in that the links are entirely or partly enclosed in a seal, with the cutters and the control lugs projecting from the seal. The seal consists of an elastic, strong, and wear-resistant plastic which adheres well to the surfaces of the links and easily penetrates the spaces within the chain during its application, to which end use is made of its liquid form. The seal is also executed in such a way as to attach to the outer faces of the saw-bar. The invention prevents the abraded wear-producing material from penetrating to the gliding faces of the saw-chain, as a result of which the life of the chain increases considerably.

The invention will be better understood by reference to the attached drawing taken in conjunction with the following discussion.

DESCRIPTION OF THE PREFERRED EMBODIMENT

Figure 1:
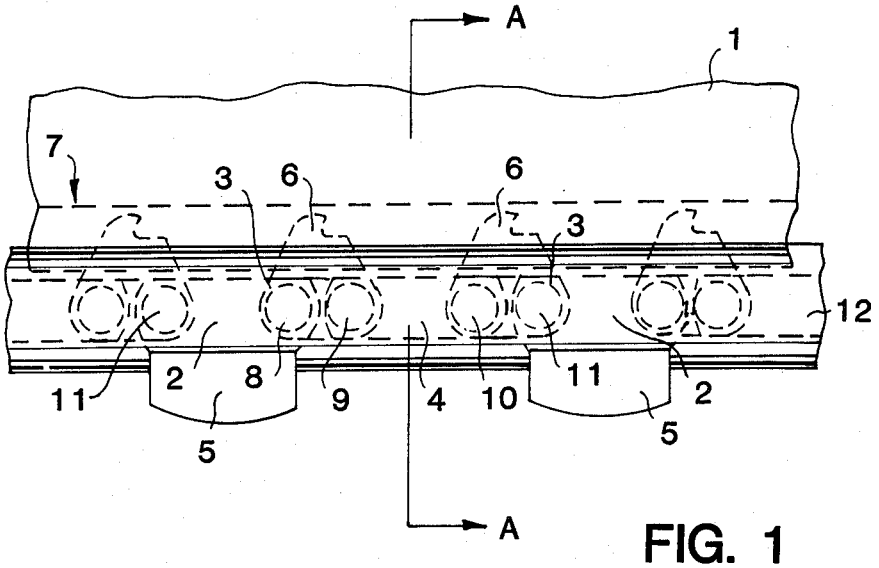
FIG. 1 shows an enlarged view of a part of a saw-bar seen from the side, on which a saw-chain moves along its lower edge.
Figure 2:
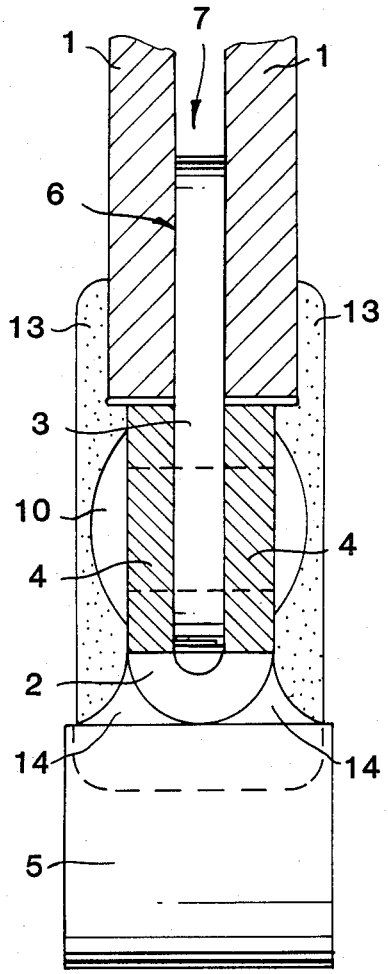
FIG. 2 shows in a further enlarged form a cross-section in accordance with the line A—A in FIG. 1.

The chain saw in accordance with the preferred embodiment of the invention comprises a motor, not shown in the figures, which drives an enclosed saw-chain that is arranged to move along the peripheral edge of a flat saw-bar 1, the saw chain comprising a series of link assemblies, each consisting of a U-shaped working link 2, the two parallel sides of which are provided with two holes arranged as a pair while at its base a cutter 5 is firmly secured and orientated away from saw-bar 1, a control link 3 provided with two holes and arranged between the sides of working link 2 on a joint pin 8 so that the other hole of control link 3 is located outside working link 2, a connecting link 4 consisting of two identical link halves provided with two holes each and fitted with the aid of a joint pin 9 in such a way that there is one link half on either side of control link 3, as well as finally yet one control link 3 fitted with the aid of a joint pin 10 between the two link halves of connecting link 4. Then follows a new link assembly consisting of a working link 2 connected via pin 11, a control link 3, a connecting link 4 and a further control link 3. Each control link 3 includes a control lug 6 which extends towards and within a guide groove 7 that extends along the periphery of the saw-bar 1.

Links 2, 3 and 4 are enclosed in a seal 12 consisting of polyurethane plastic known as ADIPREN (a trademarked product made by Uniroyal), which is applied in a liquid form and which penetrates into the spaces within the chain, adhering firmly to the opposite link faces. Seal 12 extends downwardly a little along the short sides of cutter 5 and encompasses the opposite faces of saw-bar 1 by means of overlapping edges 13. The width of seal 12 is identical with the width of cutter 5, thus making it possible to lower, in the process of sawing, saw-bar 1 into the saw-cut without any damage to seal 12.

Cutter 5 consists of a sintered element comprising diamond grain. Cutter 5 is substantially shaped as a rectangular parallelpiped, one wall of which consists of part of a cylindrical surface. Cutter 5 is attached to working link 2 with the cylindrical surface arranged at right angles toward the plane through the saw-bar, as a result of which the cutting edge of cutter 5 is given an obtuse angle, which reduces the danger, of damage especially when sawing with the end of saw-bar 1 where the saw-chain is bent around the end of the latter so that the angle of attack of cutter 5 in respect of the material to be worked upon becomes unfavourable. Cutter 5 is attached to working link 2 by means of a hard-brazed area 14 at its U-shaped base.

With alternative embodiments of the chain-saw in accordance with the invention the connecting links 4 can be replaced by a working link 5. It is also possible to make use of links, not shown in the figures, without control lugs 6 instead of, e.g., every other control link 3. Alternatively, working link 5 can be provided with a seat, not shown in the figures, for cutter 5, thus enabling higher loadings.

I claim:

1. In a chain saw useful in sawing through hard materials which includes a motor; a flat saw-bar which includes opposite side faces and a peripheral edge that includes a guide groove extending therein, said flat saw-bar defining an operating plane; and an endless saw-chain which is located around the periphery of said saw-bar and is movable therealong by said motor, said saw-chain including a plurality of interconnected link assemblies, each link assembly including three links which are pivotally connected to one another and which define opposite side faces, at least one of said three links including a cutter element which extends in said operating plane away from said saw-bar and at least one other of said three links including a control lug which extends into said guide groove in the peripheral edge of said saw-bar; the improvement wherein each said link assembly includes a unitary plastic seal means which is firmly attached to at least a portion of each of the opposite side faces of each of said three links thereof, said plastic seal means protecting said links from being damaged by abrasive particles, said unitary plastic seal means including edges which extend over the opposite side faces of said flat saw-bar.

2. Th chain saw as defined in claim 1, wherein said plastic seal means includes portions which abut the peripheral edge of said saw-bar.

3. The chain saw as defined in claim 1, wherein one of said three links of each link assembly comprises a U-shaped working link which includes a cutter element attached thereto, a second link of said three links comprises a control link which includes a control lug which extends into the guide groove in the peripheral edge of said saw-bar, and the third link of said three links comprises connecting link, each of said three links being pivotally connected to one another by a joint pin.

4. The chain saw as defined in claim 3, wherein the cutter element attached to each U-shaped working link has a greater width than the width of the associated working link, and wherein said unitary plastic seal means has a thickness which is equal to that of said cutter element.

* * * * *